US008162250B2

(12) United States Patent
Hashikawa

(10) Patent No.: US 8,162,250 B2
(45) Date of Patent: Apr. 24, 2012

(54) ENDLESS BELT WITH SLITS FOR BELT-TYPE BAND SHEET COILING TENSION APPLYING APPARATUS

(75) Inventor: Yoshito Hashikawa, Sasebo (JP)

(73) Assignee: Japan Development Consultants, Inc., Nagasaki-Ken (JP)

( * ) Notice: Subject to any disclaimer, the term of this patent is extended or adjusted under 35 U.S.C. 154(b) by 331 days.

(21) Appl. No.: 12/574,125

(22) Filed: Oct. 6, 2009

(65) Prior Publication Data

US 2010/0084502 A1 Apr. 8, 2010

(30) Foreign Application Priority Data

Oct. 6, 2008 (JP) ..... 2008-259866

(51) Int. Cl.
*B65H 23/188* (2006.01)

(52) U.S. Cl. ..... 242/419.5; 242/419.8; 242/420.2

(58) Field of Classification Search ..... 242/419.5, 242/419.8, 420.2; 226/195
See application file for complete search history.

(56) References Cited

U.S. PATENT DOCUMENTS

| | | | | |
|---|---|---|---|---|
| 3,386,679 | A * | 6/1968 | Foulon et al. | 242/419.5 |
| 3,433,398 | A * | 3/1969 | Moore et al. | 226/93 |
| 3,735,937 | A * | 5/1973 | Plantard | 242/419.5 |
| 5,265,817 | A * | 11/1993 | Gaudin | 242/419.5 |
| 6,964,392 | B1 * | 11/2005 | Matsunaga | 242/419.4 |
| 6,978,961 | B2 | 12/2005 | Hashikawa | |

FOREIGN PATENT DOCUMENTS

| | | | |
|---|---|---|---|
| DE | 19852078 | A1 | 5/2000 |
| JP | 56-082755 | A | 7/1981 |
| JP | 62-113814 | U | 7/1987 |
| JP | 2701004 | B2 | 10/1997 |
| JP | 3769730 | B2 | 2/2006 |

OTHER PUBLICATIONS

European Search Report issued in European Application No. 09172347.8-1256 dated Feb. 8, 2011.

* cited by examiner

*Primary Examiner* — Sang Kim
(74) *Attorney, Agent, or Firm* — Sughrue Mion, PLLC

(57) ABSTRACT

A number of closely notched slits 35 of a predetermined depth which have fine convex portions of the surface of each band sheet bitten thereinto and which are pulled to the convex portions and deformed to form cavities to generate negative pressure are provided at predetermined intervals over the entire peripheral length of the endless belt, over the entire width of the belt in a width direction to a longitudinal direction of the endless belt, on the outer surface 31*a* of the endless belt 3, touching each band sheet 4, which is constructed by laminating an outer surface layer 31 and an inner surface layer 33 using at least two-layer different materials.

2 Claims, 18 Drawing Sheets

COMPARATIVE EXPERIMENTAL VALUE OF SLIT INTERVAL AND HOLDING FORCE

COMPARISON OF HOLDING FORCE VALUE FOR PATTERN OF ENDLESS BELT

ENDLESS BELT WITH SLITS FOR BELT-TYPE BAND SHEET COILING TENSION APPLYING APPARATUS

BACKGROUND OF THE INVENTION

1. Field of the Invention

The present invention relates to an endless belt used for a belt-type band sheet coiling tension applying apparatus which applies a uniform and sufficient tension to each slit band sheet without generating scratches on the surface of the band sheet when the band sheet after slitting is recoiled, in a slitter line for slitting a wide metallic band sheet into a plurality of band sheets along the longitudinal direction of the band sheet or a trimming line for cutting off ear portions at both ends of the band sheet to slit the band sheet into a band sheet having a specific width, and specifically, to an endless belt with slits capable of applying a sufficient coiling tension without any relative slip between a band sheet and the endless belt even in a state when rolling oil or rustproof oil has adhered to the surface of the band sheet.

2. Description of the Related Art

As for patent techniques utilizing any difference in frictional coefficient between a surface and back layers of an endless belt for belt-type band sheet coiling tension applying apparatus, these are disclosed in JP56-A-82755 and U.S. Pat. Nos. 3,769,730, etc. In applications of these inventions, synthetic-rubber-based and synthetic-resin-based materials having a large frictional coefficient are utilized for the surface layer material on the side touching the metallic band sheet, and a synthetic-fiber-based material, such as polyester having a small frictional coefficient is utilized for the back material. However, in a band sheet on the surface of which oil is applied, a frictional force is remarkably lowered due to an oil film on the surface of the band sheet, and the band sheet and the surface of the endless belt slips, and the belt does not rotate in synchronization with the coiling speed of the band sheet. Thus, scratches are not generated on the surface of the band sheet, or sufficient tension is generated. Therefore, these techniques are not satisfactory when oil adheres to the band sheet.

Thus, new techniques are shown in Prior Japanese Patent No. 2701004 in which an endless belt is composed of three-layer different materials of an outer layer, an interlayer, and an inner layer, and the frictional coefficient on the back side of the belt is made small such that the interlayer is made to contain lubricating oil, and the contained oil is oozed out to the back side of the endless belt by providing guide through holes for lubricant passing through the interlayer to the inner layer, and a technique in which an oil film is partially cut by providing irregular patterns on the outer layer of the surface of an endless belt to strongly push convex portions against the surface of the band sheet, and the difference in frictional coefficient with the backside of the belt is retained by increasing the frictional force between the belt and the band sheet. Actually, however, these techniques are not practical because the oil film of the band sheet on which oil is applied cannot be removed simply by providing holes in the flat belt shown in Japanese Patent No. 2701004, and only the endless belt made of a surface layer material having a number of dents is put into practical use.

However, in recent advances of a rolling technique of metallic band sheets or the recent diversification of the surface treatment of band sheets or for press molding as a post step, use of band sheets which are easier to slip are increasing. Moreover, rustproof oil, or lubricant for press working is applied in many such band sheets that are easy to slip. Even if such a special endless belt as mentioned above is used, the coiling speed of the band sheet has a limit up to about 50 m per min. In coiling at higher speed than the said coiling speed, the oil film cannot instantaneously be cut, and the frictional force between the belt convex portions and the band sheet becomes insufficient. As a result, at the present time, productivity significantly is limited due to the occurrence of the slip of the endless belt.

In the belt-type coiling tension applying apparatus of this Japanese Patent No. 2701004, a pressing mechanism on which a pair of upper and lower endless belts are mounted is driven, and a band sheet is nipped in a sandwiched manner by the upper and lower endless belts. Moreover, a coiling tension is adjusted by increasing and reducing the pressure of a pressure cylinder annexed to the pressing mechanism. However, even if the pressure of the pressure cylinder is raised, the surface of the endless belt completely cannot remove the oil film of the band sheet on which oil is applied. Therefore, when the thickness of the band sheet is relatively large, tension becomes insufficient. Alternatively, when the thickness of the band sheet is relatively small, convex projections on the surface of the endless belt is strongly pushed against the band sheet. Therefore, concavely dented deformation is caused in the surface of the band sheet. Thus, this technique cannot be adapted to a relatively thin band sheet.

Patent Document 1: JP56-A-82755

Patent Document 2: Japanese Patent No. 2701004

Patent Document 3: Japanese Patent No. 3769730

In the prior techniques, when some or the entire belt does not rotate in synchronization with the coiling speed of the band sheet due to an insufficient frictional force on the surface of the endless belt, slip marks are attached to the surface of the band sheet. Therefore, an undesirable defect occurs simply by coiling operation, and consequently, products are not obtained. Thus, the coiling speed is lowered to 50 m or less per min, and operation is barely performed. Hence, an endless belt which rotates in synchronization with the bans sheet speed even at 200 m/min or 300 m/min which is the highest speed inherent in a line and which has no concern about slip marks or the like is desired (the coiling speed is not raised).

The oil film is removed by the convex portions of the surface layer member of the endless belt, and the oil removed into the cavities between the convex portions is collected. In this regard, since escape holes for oil exists in some of the cavities, the oil escapes to the back of the belt. However, since the oil in the cavities with no oil escape holes is sealed, and the oil film remains, slip is likely to occur. Therefore, application to a relatively thick band sheet which requires a large coiling force cannot be made, thereby limiting the thickness of a band sheet to be applied (cannot be applied to a thick band sheet).

Alternatively, since the surface pressure in the convex portions becomes high in an endless belt on the surface of which cavities or irregularities exist, a relatively thin band sheet is nipped and held by the irregular surface of the belt. Therefore, there is a drawback in that irregular marks are attached to the band sheet. Also, when the pressing force of the belt is lowered in order to avoid this, the coiling tension becomes insufficient, becomes nonuniform or slip occurs. As a result, a band sheet coil is not securely and firmly coiled, and coiling of the band sheet coil may collapse (cannot also be applied to a thin band sheet).

Although the previous prior techniques as described above depends on the frictional force between the surface of the band sheet and the surface of the endless belt, there is instability that the oil film of the surface of the band sheet coil cannot completely be removed by any means. Although this unstable factor needs to make the frictional coefficient between the band sheet and the surface layer material of the endless belt larger than the frictional coefficient on the backside of the endless belt, there is a limitation on the frictional force in a state where an oil film remains.

Meanwhile, the surface of the band sheet has a surface roughness (refer to FIG. 17) of several microns formed by a rolling mill roll during the continuous rolling manufacture of the band sheet coil, or plated fine irregularities of the surface of the band sheet (refer to FIG. 18). Although the surface roughness of a metallic band sheet varies depending on the applications of the band sheet, steel bands used for automobiles or home appliances are finished to a moderate surface roughness in consideration of image clarity or the like after press molding or finishing as a post step. In this case, since the maximum roughness is approximately 1 μm to 5 μm, and the peak and valleys of the irregularities spread on the entire surface of the band sheet, it is general that the pitch number PPI (stands for Peaks Per Inch and represents the number of peaks per 1 inch (length)) of peaks of the irregularities is approximately 100. That is, peaks with 100 (number of peaks)/25.4 mm (length), i.e., four per 1 mm (length) and a height of several microns continuously are repeated in the irregularities on the surface of the band sheet.

In consideration of the above-described problems, the invention was contrived in order to solve the problems, and the object of the invention is to provide an endless belt with slits for a belt-type band sheet coiling tension applying apparatus allowing positive application of a coiling tension without any relative slip by providing a number of closely notched slits with a predetermined depth at predetermined intervals on the outer surface of the endless belt in order to focus on the surface roughness of several microns of the surface of the band sheet or plated fine irregularities of the surface of the band sheet, and catch micron-size peaks and valleys of the surface of the band sheet, thereby catching the band sheet on which an oil film remains as fine convex portions of the surface of the band sheet bitten into the slit portions, respectively, and simultaneously sucking the band sheet on which an oil film remains as the slit portions which are brought close to each other and have no gap are pulled to the fine convex portions of the surface of the band sheet which have bitten thereinto, and are deformed to form cavities to generate negative pressure, and all of a number of the slits of the endless belt touching the surface of the band sheet serves as a vacuum pump.

SUMMARY OF THE INVENTION

In order to solve the above problems, the invention provides an endless belt with slits for a belt-type band sheet coiling tension applying apparatus in which a plurality of endless belts are juxtaposed to face each other like forming a common nipping surface in portions on both sides of each band sheet while each band sheet after a wide band sheet is slit into a plurality of band sheets along a longitudinal direction of the band sheet and is coiled and supplied to a coiling apparatus, each of the endless belts is driven by a friction engagement between the endless belt and each band sheet coiled and is moved toward the band sheet coiling apparatus, and is provided so as independently and circularly to move integrally with the band sheet, and a predetermined coiling tension is applied to each band sheet by pressing an inner surface of each endless belt. Here, a number of closely notched slits of a predetermined depth which have fine convex portions of the surface of each band sheet bitten thereinto and which are pulled to the convex portions and deformed to form cavities to generate negative pressure are provided at predetermined intervals over the entire peripheral length of the endless belt, over the entire width of the belt in a width direction with respect to a longitudinal direction of the endless belt, on the outer surface of the endless belt, touching the band sheet, which is constructed by laminating an outer surface layer and an inner surface layer using at least two-layer different materials.

According to the invention including a means for solving the above problem, the following excellent effects can be exhibited.

By providing a number of closely notched slits with a predetermined depth at predetermined intervals on the outer surface layer of the endless belt in order to focus on the surface roughness of several microns of the surface of the band sheet or plated fine irregularities of the surface of the band sheet, and catch micron-size peaks valleys of the surface of the band sheet, the slits can catch the band sheet on which an oil film remains as the peak portions, i.e., convex portions of the fine peaks and valleys of the surface of the band sheet bitten into the slits, respectively. This allows the endless belt to travel and circulate integrally with the band sheet without any slip with the band sheet on which an oil film remains.

In accordance with this, the band sheet is pressed in a sandwiched manner, and is nipped and begins to be coiled by the upper and lower endless belts, each endless belt is pulled to the fine peaks and valleys of the surface of the band sheet and deformed in a state where the slit portions of the endless belt are compressed, the deformed slit portions form cavities in closely located portions therein, the cavity portions generate the negative pressure in vacuum to cause a suction action, and the slit portions in which the suction action has been caused suck the surface of the band sheet on which an oil film remains. As a result, a close contact force further is raised.

In this way, by catching the band sheet on which an oil film remains as a number of convex portions provided on the surface of the band sheet having the surface roughness bite into a number of slits formed on the outer surface layer of the endless belt, respectively, and simultaneously, all of a number of the slits of the endless belt touching irregularities of the peaks and valleys of the surface of the band sheet serve as a number of vacuum pumps, a predetermined coiling tension can be applied to the band sheet coiled around a coiling machine through the endless belt. In addition, since the endless belt and the band sheet reliably travel in synchronization with each other without any relative slip, there is no concern about scratches, and since the tension can be controlled in proportion to a pressing force even in a thick band sheet, the invention can be adapted to a wide range of sheet thicknesses.

Conventionally, a band sheet coil on which oil is applied is carefully operated by lowering the speed to 50 m/min or less by a nonwoven mat called a tension pad or an endless belt having irregularities in the surface of Japanese Patent No. 2701004, though imperfect. However, if the endless belt of the invention is mounted, a person need not be concerned about scratches of the surface of the band sheet. Thus, the operation can be performed at the maximum speed of an original line, thereby markedly improving productivity.

In addition, all band sheet materials can also be processed by the endless belts by assembling the apparatus of FIGS. 2 and 3 as an apparatus of four-stage endless belts as shown in FIGS. 11 and 12, mounting conventional endless belts for drying on upper two stages of the present application, and mounting endless belts for a lubricating material on the lower two stages. As a result, adhesion of scratches or soiling marks is eliminated irrespective of lubricated or non-lubricated band sheets. This greatly contributes to improvement in quality and an improvement in yield.

Since there are no irregularities in the surface of an endless belt as in Japanese. Patent No. 2701004, even in thin band sheet materials, coiling stably can be performed with no push marks caused by convex portions.

Moreover, for a band sheet coil for automobiles on which oil is applied or for smooth pressing working, a high-quality surface finish material for home appliances on which oil is applied and coated can also be applied without problems.

The rolling oil or rust-proof oil which is applied on the surface of the band sheet is removed to a number of through holes provided in the outer surface of the endless belt, thereby preventing an oil film of the rustproof oil from being formed between the surface of the band sheet and the outer surface, so that the slip between the outer surface of the endless belt and the surface of the band sheet further can be prevented. Moreover, a portion of the rustproof oil or the like eliminated on the inner surface of the endless belt through the through holes serves as lubricant for the inner surface of the endless belt. Accordingly, the number of supply of the lubricant can be reduced, and the frictional coefficient with a member that presses the inner surface can be kept small and constant. Therefore, the circular movement of the endless belt further can be smoothed.

DESCRIPTION OF THE PREFERRED EMBODIMENTS

Figure 1:
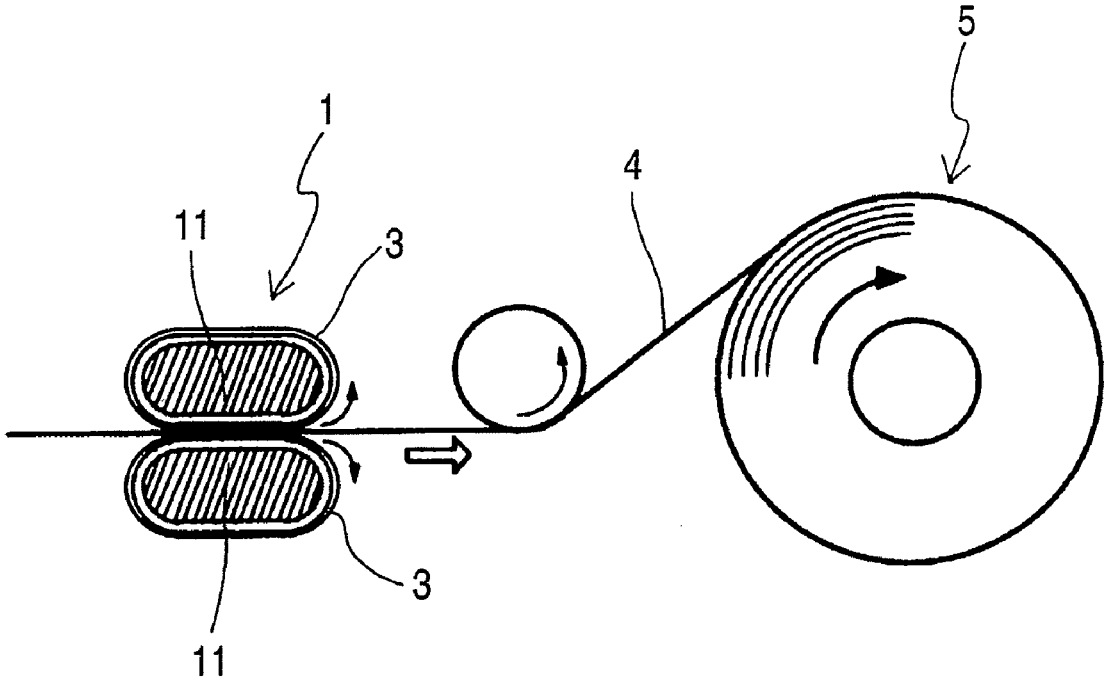
FIG. 1 is an arrangement view of a belt-type band sheet coiling tension applying apparatus showing the best mode for carrying out the invention.

The invention will be more specifically described below on the basis of best modes for carrying out the invention set forth in the drawings.

In the drawings, a belt-type band sheet coiling tension applying apparatus 1 or 2 is an apparatus which applies a predetermined coiling tension to a metallic band sheet 4 via an endless belt 3. As shown in FIG. 1, the band sheet coiling tension applying apparatus 1 or 2 (the belt-type band sheet coiling tension applying apparatus 1 is shown in FIG. 1) is disposed at the middle of a moving path of the band sheet 4 in front of a band sheet coiling apparatus 5. As for the belt-type band sheet coiling tension applying apparatuses, for example, there is included a type of a so-called elliptical drum system (Japanese Patent No. 3769730) shown in FIGS. 1 and 2 and a type of a pulley system (Japanese Patent No. 1361033) shown in FIG. 3.

Figure 2:
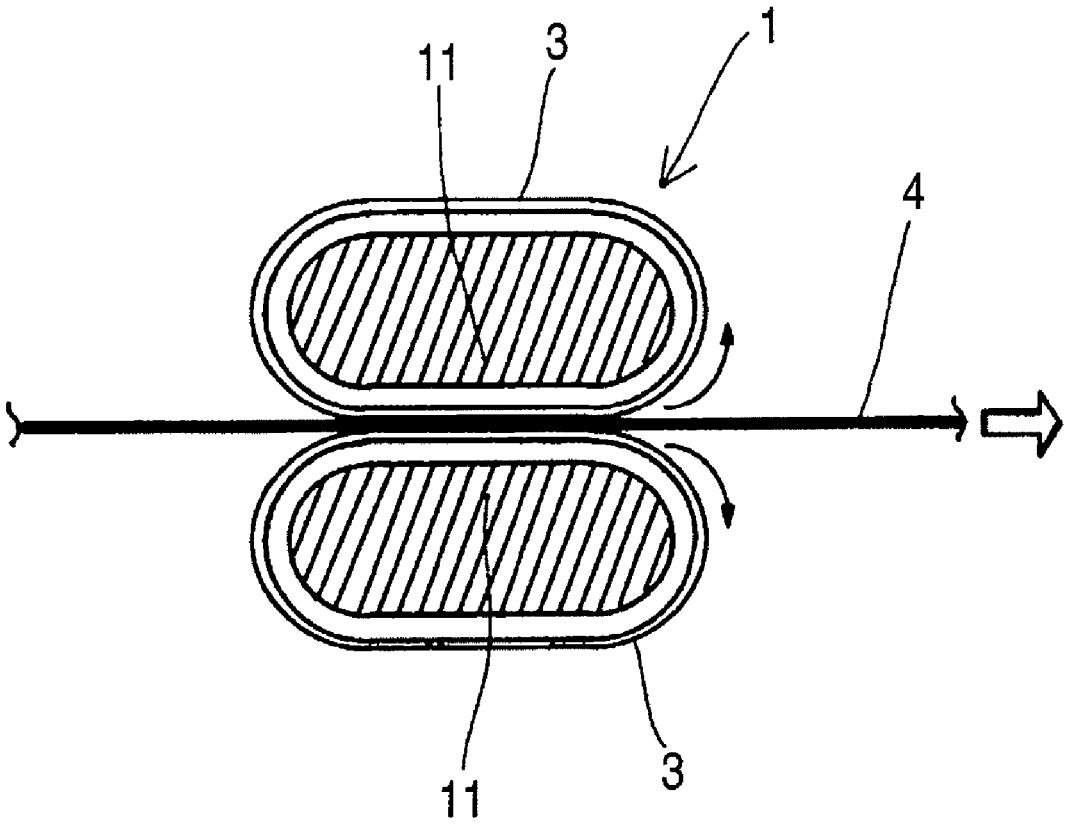
FIG. 2 is a schematic view of a belt-type band sheet coiling tension applying apparatus of an elliptical drum system showing the best mode for carrying out the invention.
Figure 3:
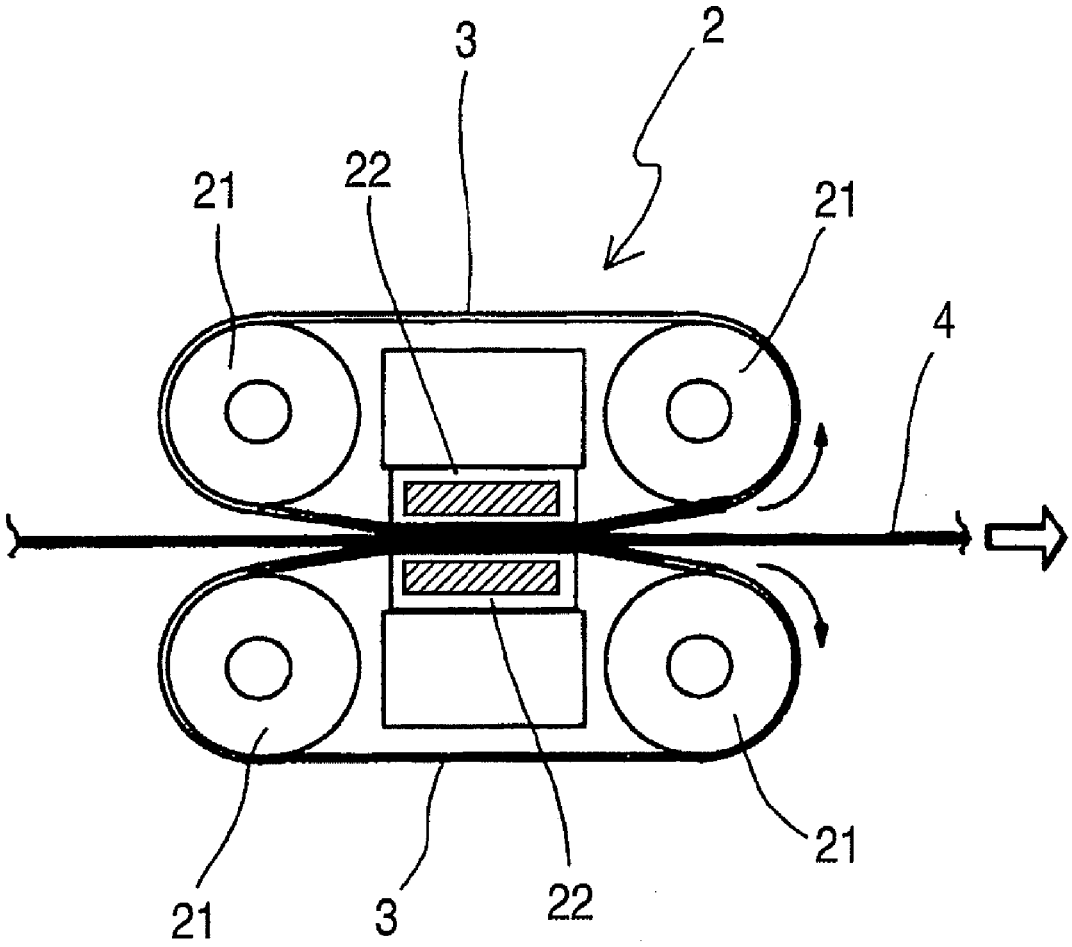
FIG. 3 is a schematic view of a belt-type band sheet coiling tension applying apparatus of a pulley system showing the best mode for carrying out the invention.

Among them, the belt-type band sheet coiling tension applying apparatus 1 of the elliptical drum system shown in FIGS. 1 and 2 is mainly constructed such that the endless belts 3 are provided in a circularly movable manner at outer peripheries of pressure applying members 11 which press the inner surfaces of the endless belts 3. The belt-type band sheet coiling tension applying apparatus 2 of the pulley system shown in FIG. 3 mainly is composed of the endless belts 3 which are tensioned in a circularly movable manner between a pair of pulleys 21, and pressing plates 22 which press the endless belts 3.

A plurality of the endless belts 3 is laterally juxtaposed, and these belts are set so as to face each other vertically. The endless belts 3 are adapted so as independently and circularly to be movable, respectively. Meanwhile, a driving source that drives the endless belts 3 is not attached to the belt-type band sheet coiling tension applying apparatus 1 or 2, and the endless belts 3 do not circularly move by themselves other than circularly moving by the frictional engagement with the band sheet 4 which is moving. That is, the endless belts 3 do not circularly move unless they touch the band sheet 4.

Common nipping surfaces of each band sheet 4 are formed between the endless belts 3 which are set so as to face each other vertically, the pressure applying members 11 or the pressing plates 22 which press the inner surfaces of the endless belts 3 toward the outside are vertically disposed parallel to each other on both sides, i.e., on the upper and lower sides of the common nipping surface, and the band sheet 4 which passes between the common nipping surfaces is compressed and pinched via the endless belts 3 from above and below by the pressure applying members 11 or the pressing plates 22.

That is, the band sheet 4 passes through mutually facing outer surfaces 31*a*, i.e., common nipping surfaces of the upper and lower endless belts 3, the endless belts 3 are pushed and compressed against the band sheet 4 from above and below by the pressure applying members 11 or the pressing plates 22 in the inner surfaces 33*a* of the endless belts 3, the endless belts 3 are driven by the frictional engagement with the band sheet 4 which is moving, and the endless belts 3 are circularly moved independently integrally in the movement direction without causing any slip with each band sheet 4 which is moving.

Also, the pressure applying members 11 or the pressing plates 22 which compress the inner surfaces 33*a* of the endless belts 3 which circularly moves by the frictional force caused by the pressure applying members 11 or the pressing plates 22 and the inner surfaces 33*a* of the endless belts 3, i.e., by the frictional engagement with the band sheet 4 which is moving serve as a brake, and are used as a mechanism which generates a coiling tension in each band sheet 4 located between the band sheet coiling apparatus 5 and the belt-type band sheet coiling tension applying apparatus 1 or 2.

Each endless belt 3 is composed of, for example, three-layer different materials of an outer surface layer 31, an interlayer 32, and an inner surface layer 33, which are made of materials having pliability. The outer surface layer 31 is a portion which becomes the outside of the endless belt 3 when the endless belt 3 is used, the inner surface layer 33 is a portion which becomes the inside of the endless belt. 3 when the endless belt 3 is used, and the interlayer 32 is a portion which is nipped in a sandwiched manner between the outer surface layer 31 and the inner surface layer 33.

Among them, the outer surface 31*a* of the outer surface layer 31 of the endless belt 3, as mentioned above, functions to move the endless belts 3 integrally without causing any slip with the band sheet 4 that is moving. The outer surface 31*a* of the endless belt 3 is formed from a material having a greater frictional coefficient than the inner surface 33*a* of the inner surface layer 33. The outer surface layer 31 is made of, for example, synthetic resins, such as synthetic rubber, urethane resin and vinyl chloride resin having a large frictional coefficient, so as to be brought into soft contact with the band sheet 4 to obtain a frictional force.

The inner surface 33*a* of the inner surface layer 33 of the endless belt 3 serves to generate a coiling tension in the band sheet 4 by the frictional force caused by any slip with the pressure applying member 11 or the pressing plate 22, and the inner surface layer 33 is made of, for example, incompressible synthetic resin fibers, such as vinylon fibers and polyester fibers, which have a lower frictional coefficient than the outer surface layer 31 and have a pliable function so that any slip with the surface of the pressure applying member 11 or the pressing plate 22 becomes easy.

The interlayer 32 of the endless belt 3 is made of a compressive elastic core material that has pliability, for example, which is made of urethane foam. The elastic compressive interlayer 32 recovers its original thickness when the compression by the pressure applying member 11 or the pressing plate 22 is released.

Figure 4A:
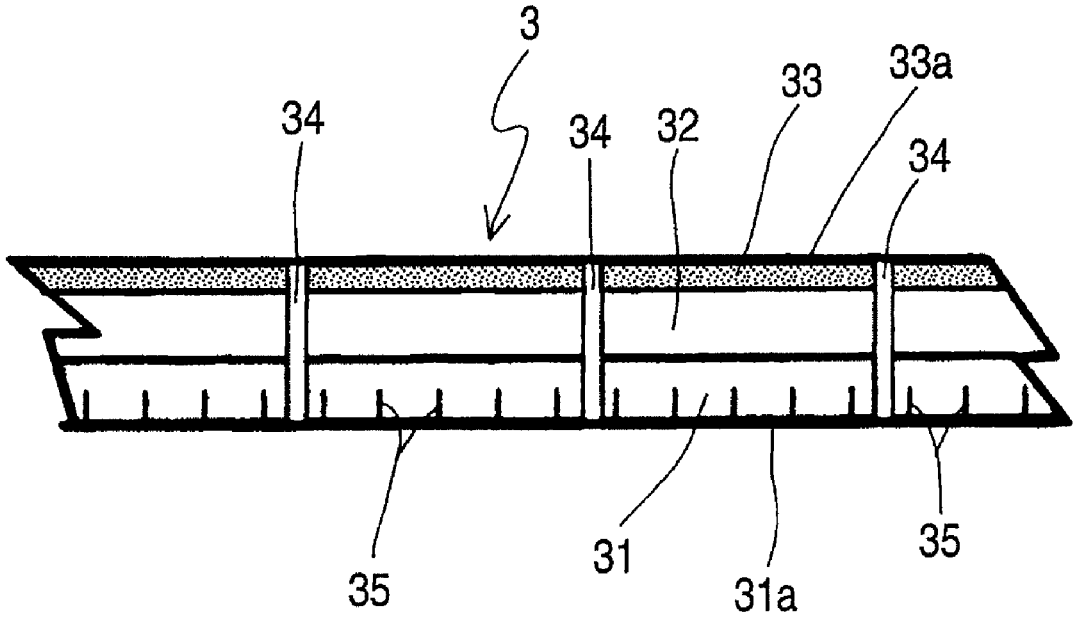
FIG. 4A is a longitudinal partial side sectional view of an endless belt showing the best mode for carrying out the invention.
Figure 4B:
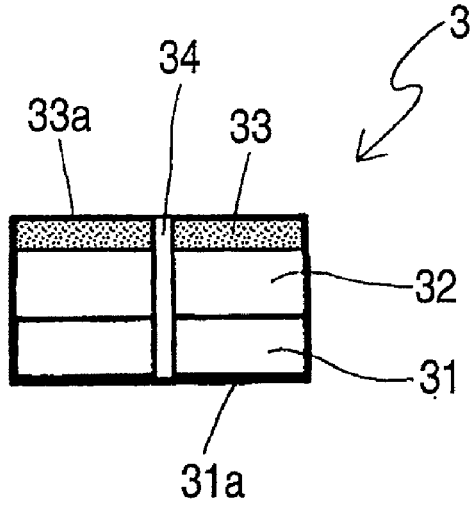
FIG. 4B is a width-direction sectional view of the endless belt showing the best mode for carrying out the invention.
Figure 5:
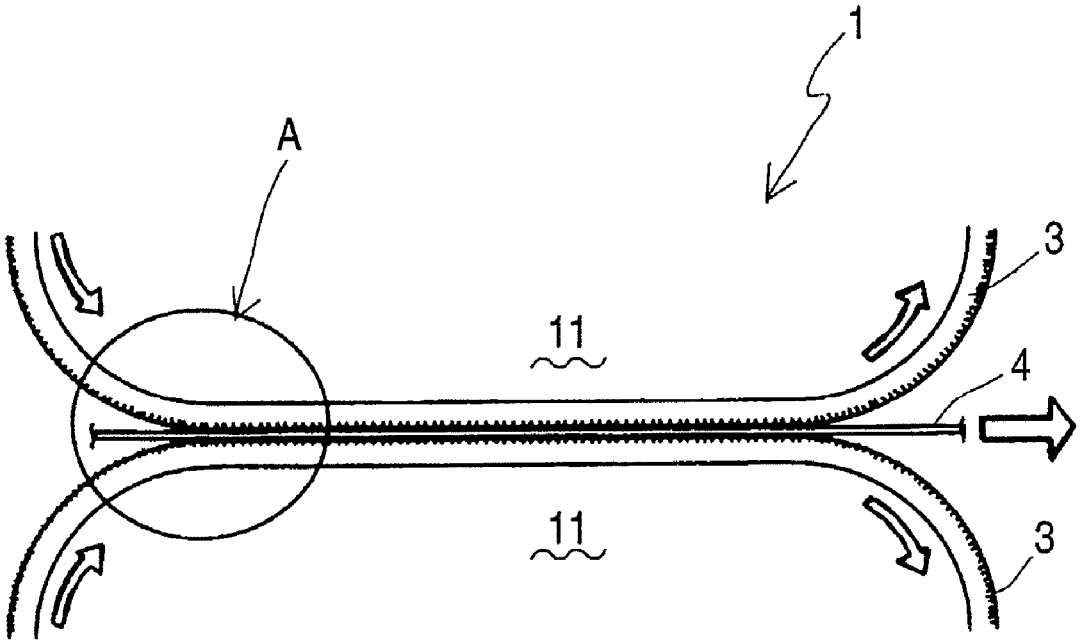
FIG. 5 is a partial side view of the belt-type band sheet coiling tension applying apparatus of the elliptical drum system showing the best mode for carrying out the invention.
Figure 6:
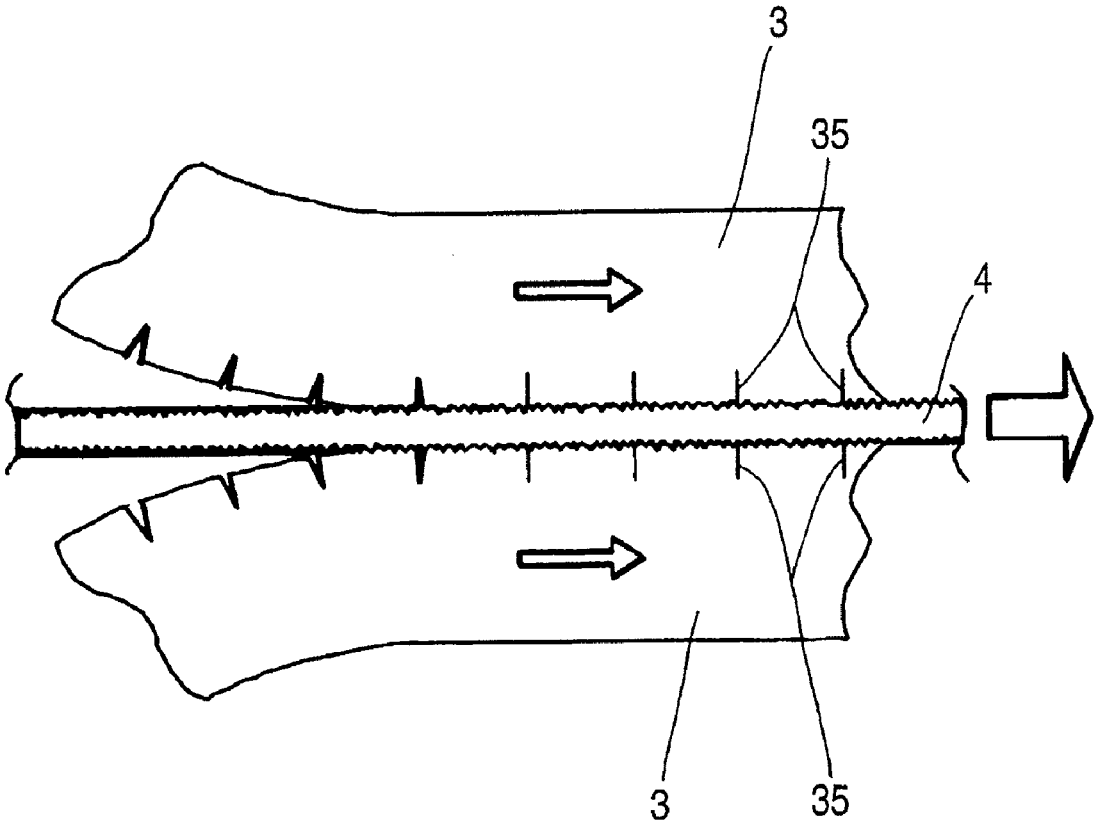
FIG. 6 is a partially enlarged view of a portion A of FIG. 5.
Figure 7:
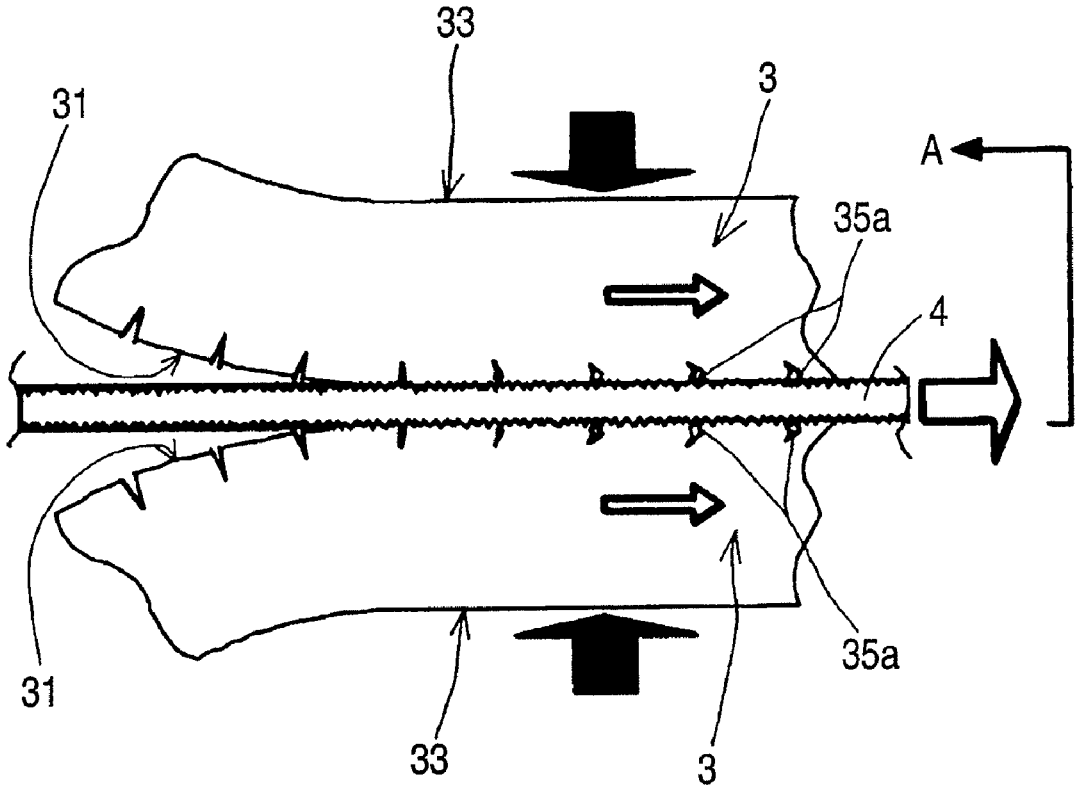
FIG. 7 is a partially enlarged view when the portion A of FIG. 5 is pressed and coiled.

In the endless belt 3, as shown in FIG. 4, through holes 34 passing through the outer surface 31*a* to the inner surface 33*a* is provided over the entire peripheral length of the endless belt at predetermined intervals. The through holes 34 provided in the endless belt 3 are portions which become passages when a portion of the lubricated oil on the surface of the band sheet 4 is made to flow to the inner surface 33*a* from the outer surface 31*a* which presses and abuts on the lubricated oil, and a portion of the lubricated oil flows out to the inner surface 33*a* through the through holes 34, and lubricates the inner surface 33*a*.

Figure 17:
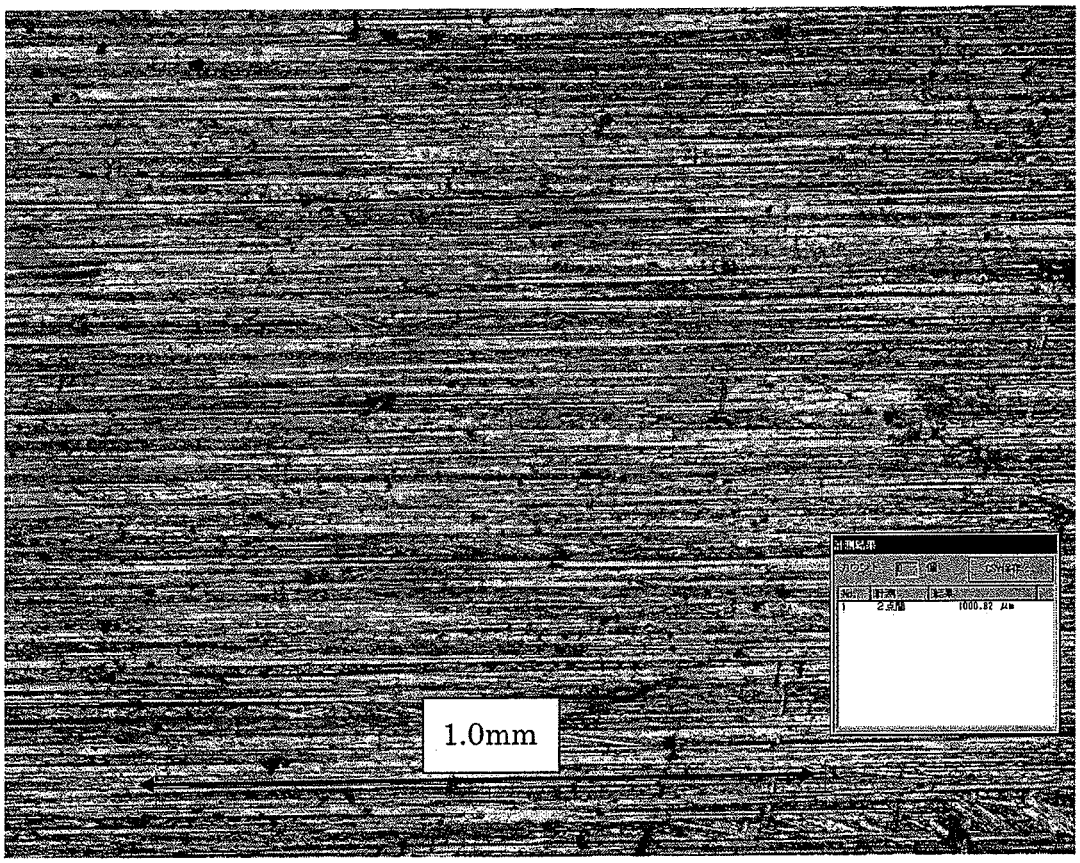
FIG. 17 is a microphotograph of the surface of a band sheet in which the roughness of a surface formed by rolling mill rolls is magnified up to 200 times.
Figure 18:
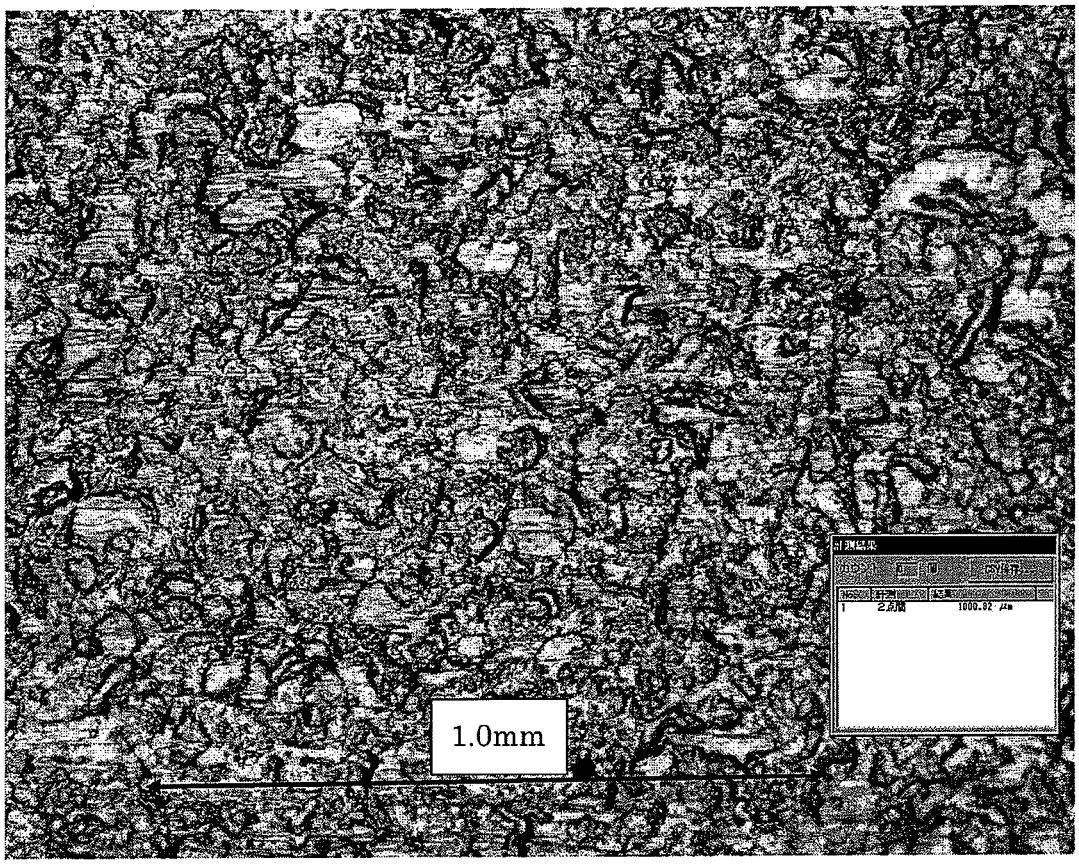
FIG. 18 is a microphotograph in which fine irregularities formed by plating are magnified up to 200 times.

A number of closely notched slits 35 with a predetermined depth of, for example, 0.5 to 1.0 mm from the surface touching the band sheet 4 are provided on the whole peripheral length of the endless belt at predetermined intervals of, for example, 1.0 to 10 mm on the outer surface 31*a* of the outer surface layer 31 of the endless belt 3 in order to focus on the surface roughness (refer to FIG. 17) of several microns of the surface of the band sheet 4 or plated fine irregularities of the surface of the band sheet 4 (refer to FIG. 18), and catch or suck micron-size peak-and-valley irregularities of the surface of the band sheet 4. The slits 35 are formed over the entire width of the endless belt 3 in a width direction, for example, perpendicular to the longitudinal direction of the endless belt 3 (refer to FIG. 8), and the formed slits 35 are parallel to one another back and forth.

The notches of the slits 35 provided in the outer surface 31*a* of the endless belt 3 are in a close contact state with no gap in a flat surface state where they touch the band sheet 4. That is, the notched slits 35 are in a state where side surfaces of both inner sides thereof are brought close to each other, and there is no gap therebetween. The close contact state exists over the entire width direction of the endless belt 3.

By pressing the endless belt 3 by the pressing plate 22 or the pressure applying member 11 or by the pulling force of the band sheet 4 which is moving, the outer surface layer 31 provided with slits 35 deforms elastically, and cavities 35*a* are formed inside the slits 35 which are brought close to each other and have no gap therebetween by the elastic deformation.

Next, the operation of the endless belts based on the configuration of the best mode for carrying out the invention will be described below.

The belt-type band sheet coiling tension applying apparatus 1 or 2 put in the middle of a moving path or on a path line applies a coiling tension to the band sheet 4 coiled by band sheet coiling apparatus 5. However, the endless belts 3 based on the above configuration, as shown in FIGS. 1 and 2, are depressed by the pressure applying members 11 in the belt-type band sheet coiling tension applying apparatus 1 and is depressed by the pressing plates 22 in the belt-type band sheet coiling tension applying apparatus 2 of FIG. 3, thereby nipping the band sheet 4 from both upper and lower sides, and compressing the band sheet 4.

Figure 8:
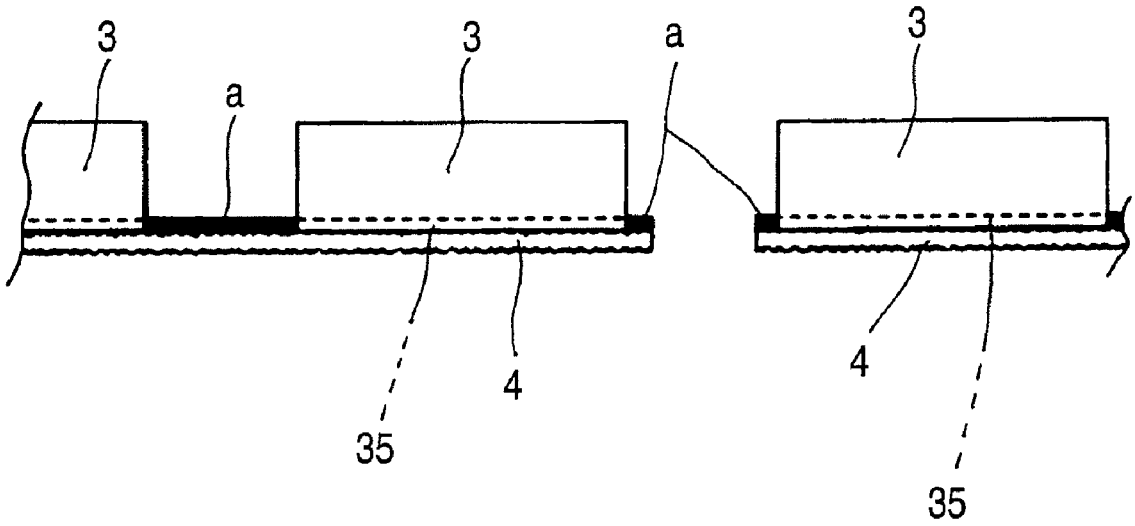
FIG. 8 is a partially sectional view as seen in the direction of an arrow A of FIG. 7.

When the band sheet 4 advances between the upper and lower endless belts 3, a portion of rustproof oil or the like a applied on the surface of the band sheet 4 is removed to the periphery of each endless belt 3 by the pressure created by the outer surface 31*a* of the endless belt 3, and another portion of the rustproof oil is removed to the through holes 34 provided towards the inner surface 33*a* from the outer surface 31*a* of the endless belt 3 (refer to FIG. 8).

A portion of the rustproof oil or the like a removed to the through holes 34 reaches the inner surface 33*a* through the through holes 34, and serves to lubricate the space between the inner surface 33*a* and the pressure applying member 11 or the pressing plate 22, and reduces the frictional resistance between the inner surface 33*a* of the endless belt 3, and the pressure applying member 11 or the pressing plate 22.

Meanwhile, on the outer surface 31*a* of each endless belt 3 compressed to both surfaces of the band sheet 4 on the surface of which the rustproof oil or the like a is applied by the pressure applying members 11 or the pressing plate 22, a number of notched slits 35 which are brought close to each other and have no gap are provided at predetermined intervals over the entire width of the belt 3 and in the peripheral length direction of the belt 3.

Meanwhile, several-micron peak-and-valley irregular portions exist on both the surfaces of the band sheet 4 due to the surface roughness of the band sheet or plated fine irregularities of the surface of the band sheet 4. As the peak portions, i.e., convex portions of the fine peaks and valleys of the surface of the band sheet 4 bite into the slits 35 which are brought close to each other and have no gap, respectively, the fine convex portions formed on the surface of the band sheet 4 are engaged with the slits 35, respectively, so that the slits 35 can catch the band sheet 4 on which an oil film remains. This enables the endless belt 3 circularly to move integrally with the band sheet 4 on which an oil film remains with no slip.

Figure 9A:
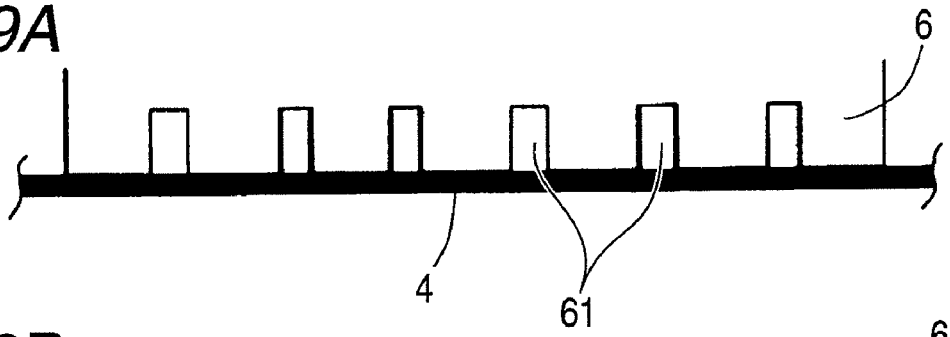
FIGS. 9A and 9B are explanatory views of the operation of an endless belt of Japanese Patent No. 2701004.
Figure 9B:
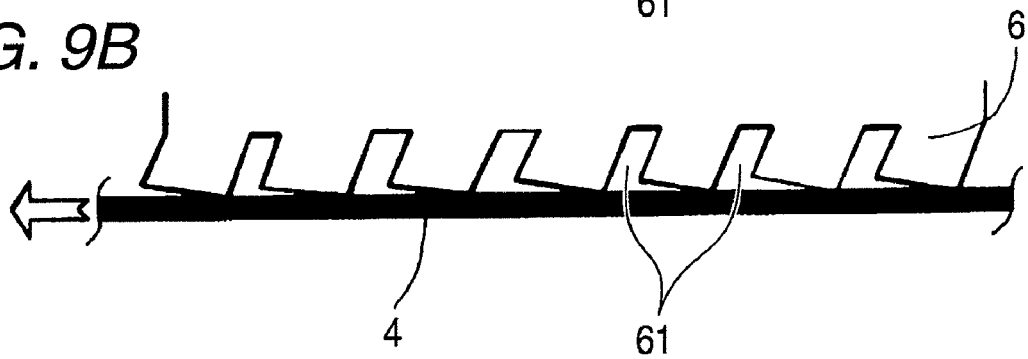
Figure 10A:
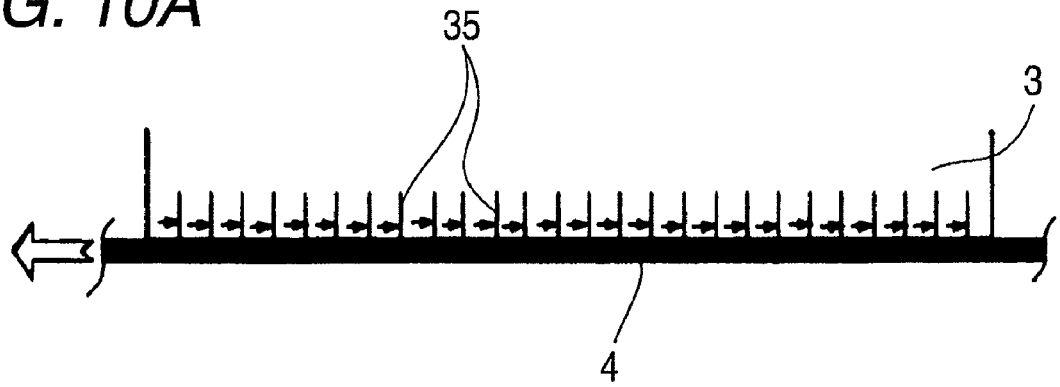
FIGS. 10A and 10B are explanatory views of the operation of the endless belt showing the best mode for carrying out the invention.

In this case, when an endless belt 6 having grooves with a sufficient gap therebetween as in Japanese Patent No. 2701004 is brought close to and pulled to the band sheet 4, a material for the endless belt is cut away in grooved spaces 61. Therefore, the belt has insufficient rigidity, deforms simply, and slips, so that the band sheet 4 cannot be caught (refer to FIG. 9). However, in the invention, since there is no gap in each slit 35 in the endless belt 3 provided with a number of closely notched slits 35 with no space, all the slits can be united and resist the pulling force, and the belt can circularly move integrally with the band sheet 4 while the irregularities of the band sheet 4 are caught depending on a slit angle (refer to FIG. 10A).

Figure 10B:
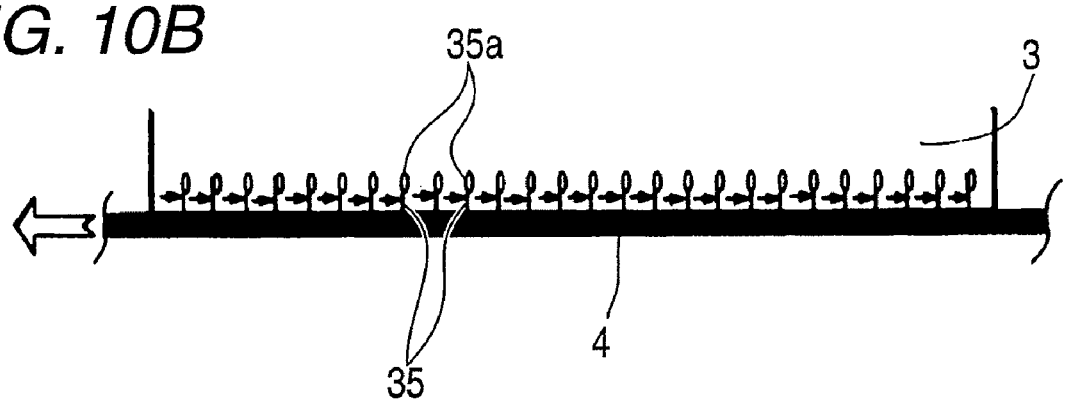
Figure 11:
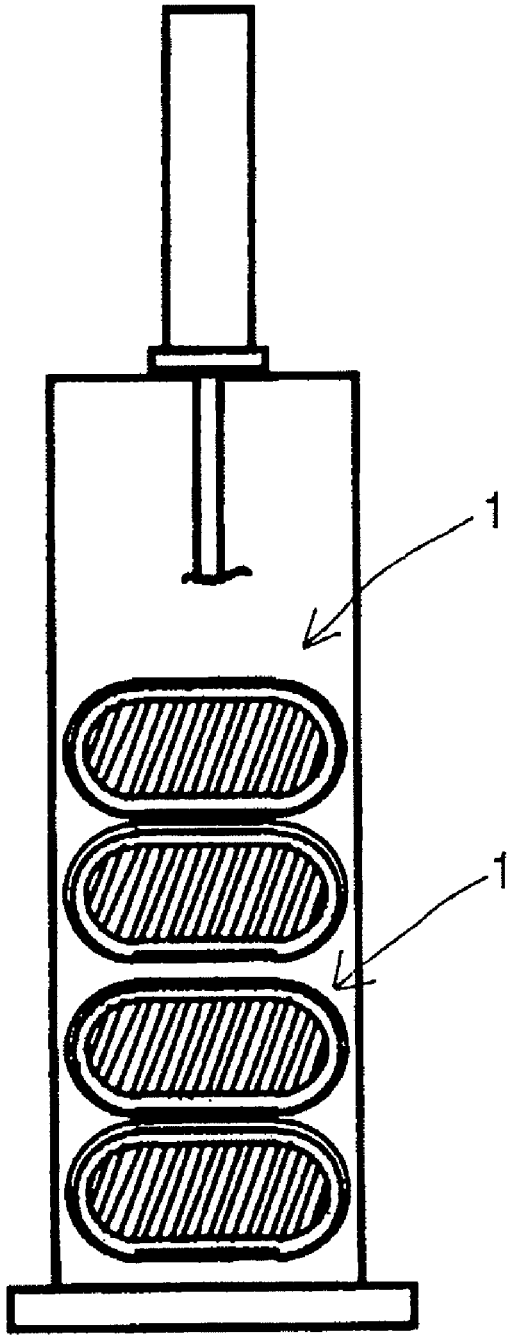
FIG. 11 is a schematic view when the belt-type band sheet coiling tension applying apparatus of the elliptical drum system is assembled in four stages.
Figure 12:
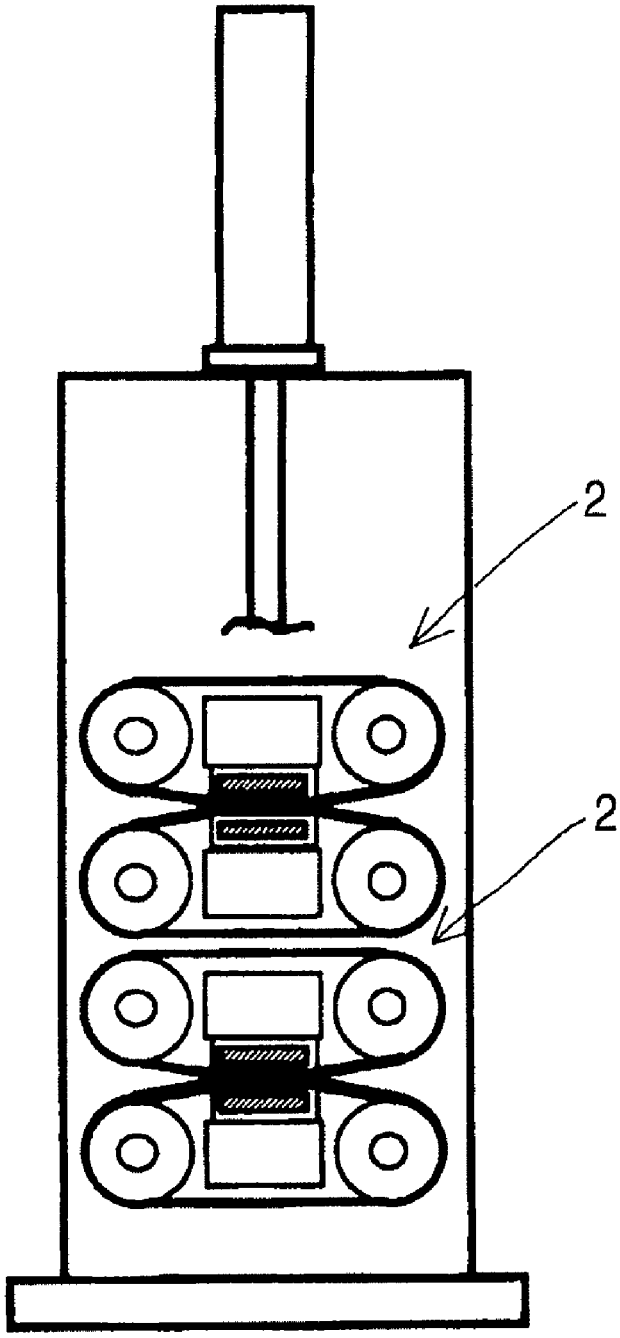
FIG. 12 is a schematic view when the belt-type band sheet coiling tension applying apparatus of the pulley system is assembled in four stages.

Since the outer surface layer 31 on the outer surface 31*a* provided with the slits 35 is a flexible elastic body, when the slits 35 receive a pulling force from the band sheet 4 or a pressing force from the pressure applying member 11 or the pressing plate 22 in a state where the lubricated surface of the band sheet 4 abuts on the surface of each slit 35 on the outer surface 31*a*, the portions of the slits 35 into which the fine convex portions of the band sheet 4 bite deforms elastically. A number of fine cavities 35*a* centering on fine convex portions of the band sheet 4 are formed in the peripheral length direction of the endless belt 3 and in the width direction of the belt inside the close slits 35 with no gap due to the deformation (refer to FIG. 10B).

The surfaces of the slits 35 in which the cavities 35*a* are formed are blocked by the surface of an oil film on which the band sheet 4 abuts, so that air cannot flow in from the outside. Since the close contact state of the slits 35 exist over the entire width direction of the endless belt 3, air does not flow into each slit 35 from both ends of the endless belt 3 in its width direction.

For this reason, the fine cavities 35*a* centering on the fine convex portions of the band sheet 4 which has bitten into the slits 35, respectively, have negative pressure in vacuum, and cause a suction action. The slits 35 in which the suction action is caused suck the surfaces of the band sheet 4 on which an oil film remains. As a result, the force of close contact of the endless belt 3 with the surface of the band sheet 4 on which an oil film remains further increases.

Example

Figure 13:
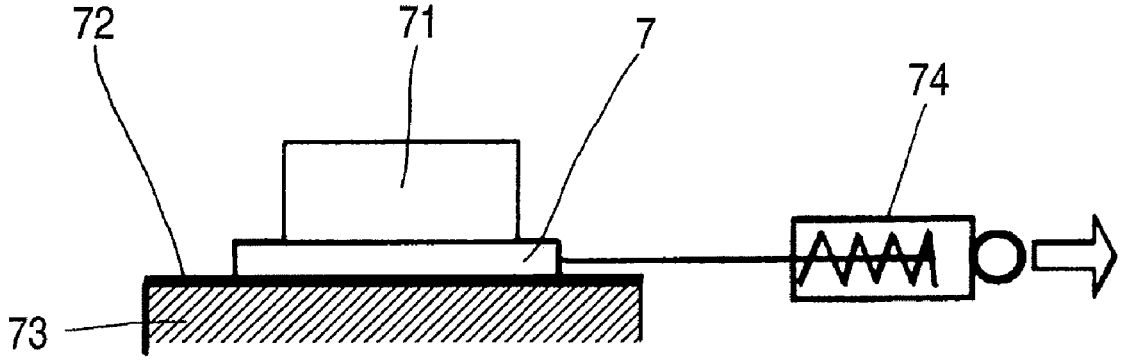
FIG. 13 is an outline view of an experiment.
Figure 14A:
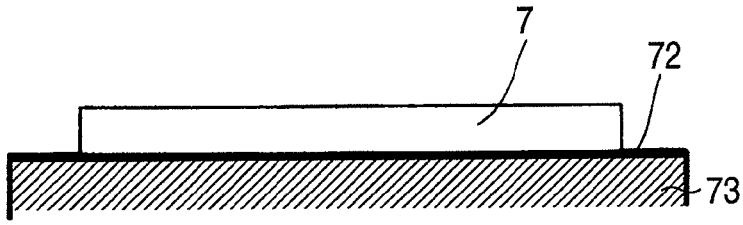
FIG. 14A is a side sectional view when the outer surface of the endless belt showing a pattern A of the experiment is a flat surface.
Figure 14B:
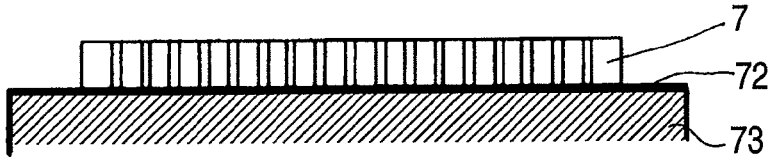
FIG. 14B is a side sectional view, when the outer surface of the endless belt showing a pattern B of the experiment has through holes.
Figure 14C:
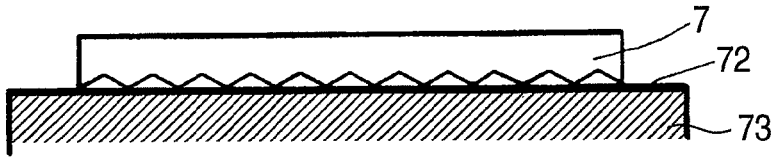
FIG. 14C is a side sectional view when the outer surface of the endless belt showing a pattern C of the experiment has V-shaped grooves that are spaces.
Figure 14D:
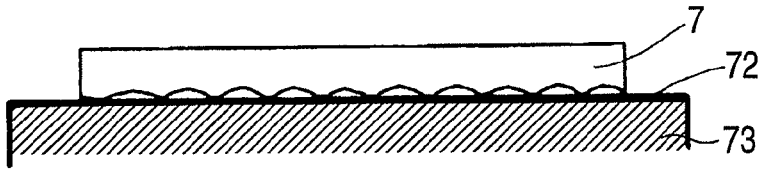
FIG. 14D is a side sectional view when the outer surface of the endless belt showing a pattern D of the experiment has chevron-shaped grooves that are spaces.
Figure 14E:
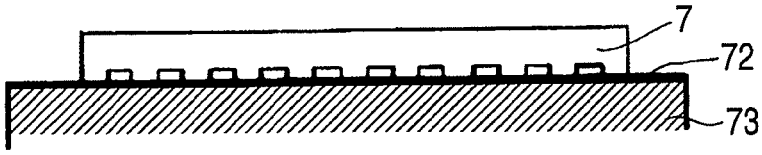
FIG. 14E is a side sectional view when the outer surface of the endless belt showing a pattern E of the experiment has grooves that are spaces.
Figure 14F:
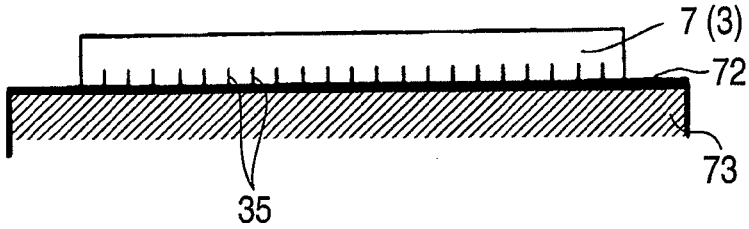
FIG. 14F is a side sectional view when slits are formed in the outer surface of the endless belt showing a pattern F of the experiment.
Figure 15:
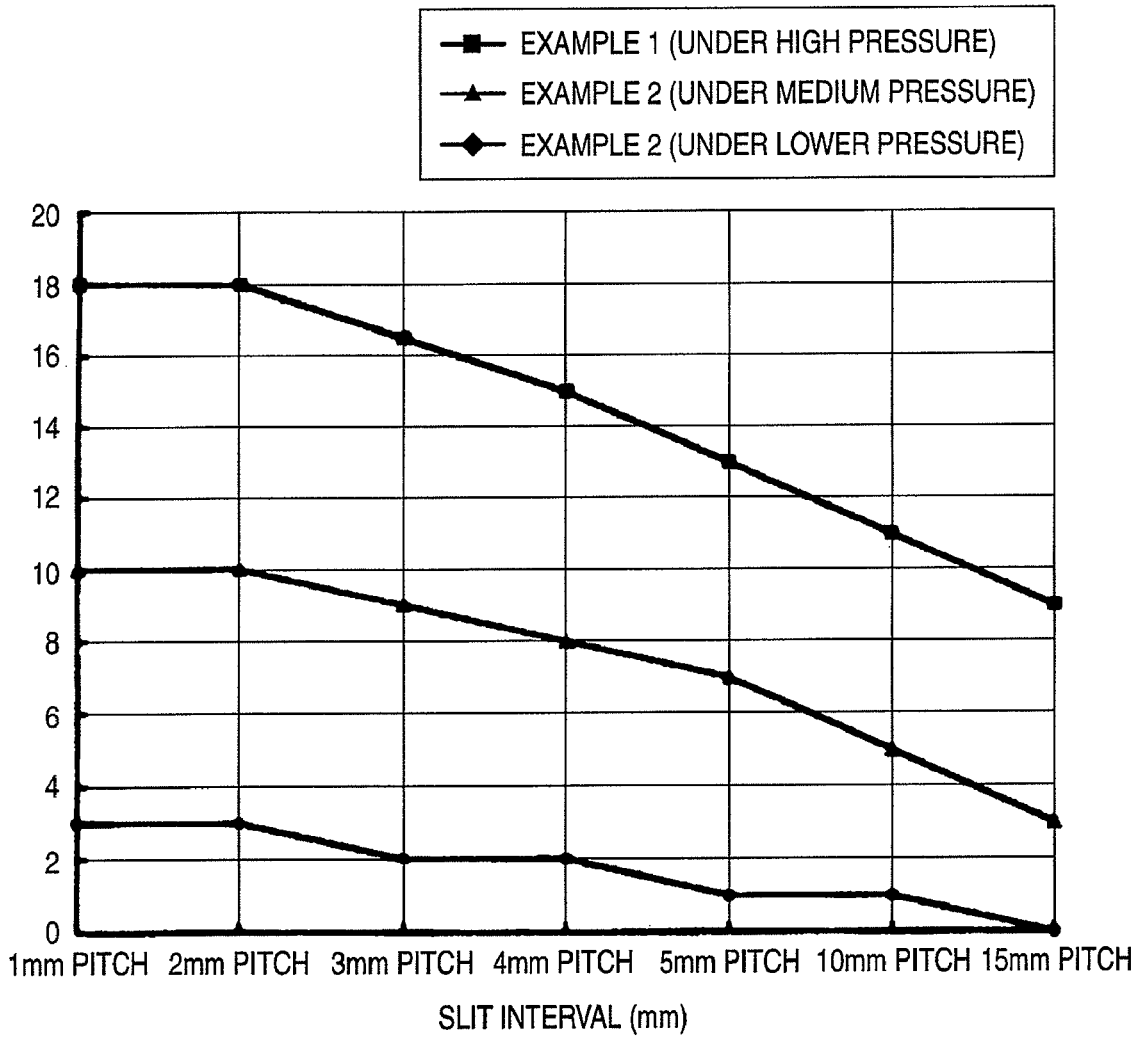
FIG. 15 is a view showing comparative experimental values of slit intervals and holding forces in the experiment.
Figure 16:
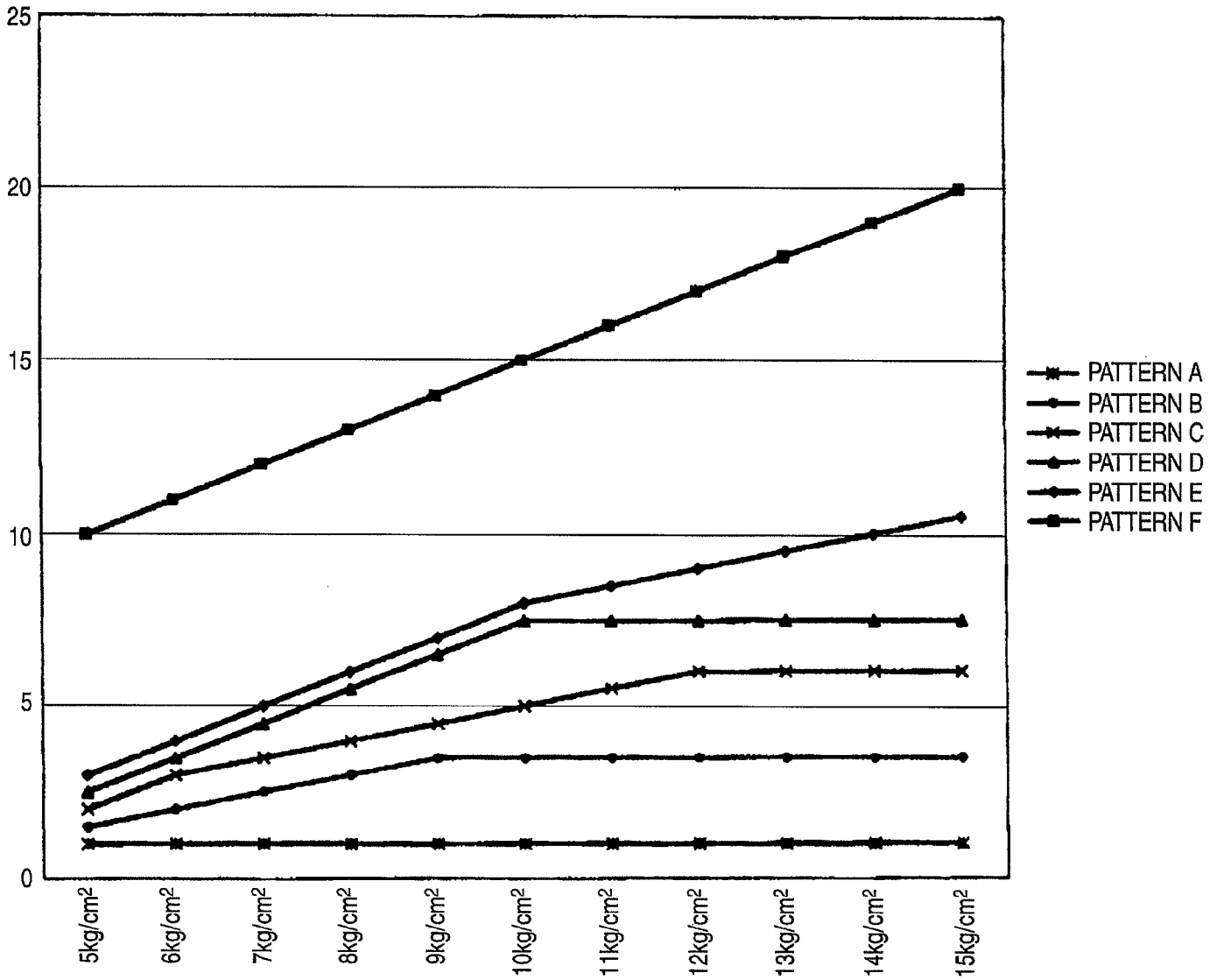
FIG. 16 is a view showing the comparison of holding force values for individual patterns of the endless belt in the experiment.

The effectiveness of a number of closely notched slits 35 provided in the outer surface 31*a* of the endless belt 3 can be confirmed even by the experiments of FIGS. 13 and 14 and by the experimental results of FIGS. 15 and 16.

As a trial, when a sample in which the interval of the slits 35 was changed from a 1 mm pitch to a 15 mm pitch was prepared and an experiment like FIG. 13 was tried, a stronger holding force was obtained as the interval of the slits becomes narrower as shown in FIG. 15. In the results when the holding forces (the value of the tension immediately before load is constant and slip begins) were experimented for comparison by changing the hardness of a resin for the selection of the outer surface layer 31 (soft resin), the holding force showed a maximum value at a hardness of 65° as follows.

| Hardness (Hs) | 40° | 50° | 65° | 85° |
|---|---|---|---|---|
| Holding force value | 5 kgf | 8 kgf | 20 kgf | 12 kgf |

When the comparative experiment of holding forces was similarly performed on the surface of the endless belt 3 by samples of belt surfaces of various patterns shown in FIGS. 14A to 14F, the results of FIG. 16 were obtained. It could be understood from the results that the holding forces do not increase or decrease in proportion to the pressing force except for the endless belt 3 with the slits 35, and are not provided for practical use.

That is, a number of slits 35 which extend to both sides in the width direction of the belt perpendicular to the belt longitudinal direction of an oil-resistant synthetic-rubber-based or synthetic-resin-based surface layer material having the aforementioned moderate elasticity are provided over the entire length of the endless belt 3 at predetermined intervals on a material of the outer surface layer 31 of the outer surface 31*a* of the endless belt 3 on the side touching the band sheet 4, and a number of convex portions provided on the surface of the band sheet 4 having the surface roughness are made to bite into the slits 35, whereby a physical holding force is obtained. In an experimental device, it is confirmed that it is possible to cope with a coiling speed of 300 m/min.

In addition, it is needless to say that the invention is not limited to the best mode for carrying out the invention, and various changes can be made without departing from the spirit of the invention. Although a case where the endless belt is three-layered has been shown in this best mode, minimally, an endless belt 3 may be adopted which is constructed using two kinds of different materials including the inner surface layer 33 having pliability and a small frictional coefficient, and the outer surface layer 31 as a pliable elastic body, which is made of a material with a thickness enough to provide a number of slits 35 with a depth about 0.5 to 1.0 mm.

What is claimed is:

1. A belt-type band sheet coiling tension applying apparatus in which a coiling tension is applied to a plurality of band sheets to be coiled by a band sheet coiling apparatus so that each of the band sheets is moved toward the band sheet coiling apparatus, comprising:

at least two sets of endless belts disposed oppositely upper and lower, each set of endless belts including a plurality of endless belts laterally arranged side by side, so as to nip both sides of each of the band sheets, each of the endless belts being driven by a friction engagement between each of the endless belts and each of the band sheets so as independently and circularly move integrally with each of the band sheets, wherein each of the endless belts includes an outer surface layer to be touched with the respective band sheets and an inner surface layer to be pressed so as to apply the coiling tension to the respective band sheets, and the outer surface layer and the inner surface layer are composed by different materials;

a plurality of closely notched slits are provided at predetermined intervals over the entire peripheral length of each of the endless belts over the entire width in a width direction to a longitudinal direction of each of the endless belts, on the outer surface layer of each of the endless belts, wherein each of the plurality of closely notched slits is formed to have at least a pair of inner sides that closely contact each other such that there is no gap therebetween when the endless belt is in a flat surface state.

2. A belt-type band sheet coiling tension applying apparatus in which a coiling tension is applied to a plurality of band sheets to be coiled by a band sheet coiling apparatus so that each of the band sheets is moved toward the band sheet coiling apparatus, comprising:

at least two sets of endless belts disposed oppositely upper and lower, each set of endless belts including a plurality of endless belts laterally arranged side by side, so as to nip both sides of each of the band sheets, each of the endless belts being driven by a friction engagement between each of the endless belts and each of the band sheets so as independently and circularly move integrally with each of the band sheets, wherein each of the endless belts includes an outer surface layer to be touched with the respective band sheets and an inner surface layer to be pressed so as to apply the coiling tension to the respective band sheets, and the outer surface layer and the inner surface layer are composed by different materials;

a plurality of closely notched slits are provided at predetermined intervals over the entire peripheral length of each of the endless belts over the entire width in a width direction to a longitudinal direction of each of the endless belts, on the outer surface layer of each of the endless belts, wherein each of the closely notched slits is formed to have a pair of inner sides of predetermined depth, the pair of inner sides deformed to (i) closely contact each other on the outer surface layer of each of the endless belts such that there is no gap therebetween when the endless belt is in a flat surface state and (ii) form a cavity inside the closely notched slit.

* * * * *